US005904195A

United States Patent [19]

Doig

[11] Patent Number: 5,904,195

[45] Date of Patent: May 18, 1999

[54] GOLF BAG COVER

[76] Inventor: Carolanne Doig, 62 John Street, Seaforth Ontario, Canada, N0K 1W0

[21] Appl. No.: 08/896,497

[22] Filed: Jul. 18, 1997

[51] Int. Cl.[6] ..... A63B 55/00; A63B 57/00

[52] U.S. Cl. ..... 150/159; 206/315.4

[58] Field of Search ..... 206/315.3, 315.4; 150/159, 160

[56] References Cited

U.S. PATENT DOCUMENTS

| | | | |
|---|---|---|---|
| D. 256,293 | 8/1980 | Edwards | 206/315.4 X |
| D. 354,852 | 1/1995 | Goodard et al. | D3/255 |
| 1,886,464 | 11/1932 | Bright | 150/160 |
| 2,704,563 | 3/1955 | Henrich | 150/159 |
| 3,521,689 | 7/1970 | Woods, Jr. | 150/159 X |
| 3,620,276 | 11/1971 | Taylor | 150/159 |
| 3,913,648 | 10/1975 | Sessler | 206/315.4 |
| 3,977,451 | 8/1976 | Duba | 150/159 X |
| 4,234,025 | 11/1980 | Berge | 150/160 X |
| 4,442,937 | 4/1984 | Delauder | 206/315.4 |
| 4,752,004 | 6/1988 | Very | 150/159 |
| 5,005,623 | 4/1991 | Webster, Jr. | 150/159 |
| 5,024,259 | 6/1991 | Treadway | 150/159 |
| 5,099,897 | 3/1992 | Curtin | 150/159 |
| 5,131,442 | 7/1992 | Bevier | 150/159 |
| 5,220,950 | 6/1993 | Cordasco | 206/315.4 X |

FOREIGN PATENT DOCUMENTS

| | | | |
|---|---|---|---|
| 341680 | 1/1931 | United Kingdom | 206/315.3 |
| 1230580 | 5/1971 | United Kingdom | 206/315.3 |

*Primary Examiner*—Sue A. Weaver

*Attorney, Agent, or Firm*—Rothwell, Figg, Ernst & Kurz, P.C.

[57] ABSTRACT

A flexible golf bag cover for protecting the interior and contents of a golf bag of the type having an open top surrounded by a peripheral rim and having a carrying strap extending laterally from the rim. The golf bag cover comprises a generally cylindrical base having an open bottom, rear and front base walls for overlapping and holding the cover on the golf bag rim, the rear base wall having an openable slit with overlapping slit side edges, each with continuous closures, for closing the slit about the carrying strap. A back wall extends upwardly from the rear wall of the base to an apex and has back lateral side edges. A front flap with front lateral side edges merges with the back lateral side edges, the front flap extending downwardly from the apex to a lower front edge, wherein the lower front edge of the front flap and a top edge of the front base wall define a flexible forwardly open mouth in an open configuration, and wherein the lower front edge of the front flap overlaps the top edge of the front base wall covering the mouth in a closed configuration. Advantageously, the front flap between the front lateral side edges is seamless, enabling printing of logos and graphics.

8 Claims, 7 Drawing Sheets

GOLF BAG COVER

TECHNICAL FIELD

The invention is directed to a flexible golf bag cover of fabric with an openable convex front flap, and a slit back with continuous closure to accommodategolf bags and strap handles of varying configuration.

BACKGROUND OF THE ART

During the course of a golf game, the players may encounter inclement weather such as constant drizzle or sudden thunderstorms. Golf clubs are carried about generally in open topped golf bags and require protection. Moisture on golf clubs and in golf bags may corrode metals, ruin finishes and damage costly equipment. In addition, wet club handles are difficult to grip increasing the risk of accidental injuries.

In response to this problem, a number of golf bag covers have been produced with limited commercial success due to various difficulties. Some covers include a number of fasteners that render them cumbersome to use and increase manufacturing costs. Preferably covers are made of flexible fabric that can be folded and easily stored in good weather, however bulkier and more permanent hard covers have been proposed also.

Examples of prior art golf bag covers are described in the following U.S. Pat. Nos.: 5,131,442 to Bevier; 5,099,897 to Curtin; 4,442,937 to Delauder; 5,024,259 to Treadway; 4,234,025 to Berge; and U.S. Pat. Des. No. 354,852 to Goddard et al.

A disadvantage of many prior art covers relates to the differences between the configuration of the golf bags commonly used. There is no completely universal size, shape, top rim configuration, or carrying strap arrangement and so many conventional covers cannot accommodate a variety of golf bags.

A particular problem is the location and size of the carrying strap that requires many covers to include a slit back with fasteners to allow the strap to protrude through the back of the cover. The treatment of this area is unsatisfactory since the slit back often allows rain to easily penetrate thereby eliminating much of the advantage of using the cover.

Therefore there is a need for a cover that can accommodate various strap and rim configurations while maintaining a uniform cover design to capitalize on the benefits of mass production manufacturing and to minimize the inventory stock required for viable retail sales activities.

A further significant disadvantage of many covers is the failure to recognize the commercial reality of modem marketing. Such products are often a vehicle for promotions that rely primarily on extensive display and recognition of trademarks. However, many covers include front flaps with limited areas for printing graphics, logos, or trademarks in a size or shape desirable to marketers.

Since golf bags and covers may be viewed on television during televised tournaments, and are often only seen from a safe distance by other golfers, there is a desire by producers to emblazon logos or trade marks of relatively large size on golf equipment. Quite often, golf tournaments are sponsored by various corporations, clubs or employers who wish to identify their trade marks with golfers, and printed souvenirs such as hats, umbrellas, golf balls and golf bags covers are freely distributed or sold extensively to participants.

The designs of prior art covers inhibit such marketing efforts by reducing the printable area on the covers. Of special consideration is the front surface of the cover that is clearly visible to bystanders and is repeatedly observed by the user whenever the cover is opened to access the clubs within the golf bag.

For example: the cover shown in U.S. Pat. No. 5,131,442 to Bevier includes a pocket to hold a score sheet; and U.S. Pat. Des. No. 354,852 to Goddard et al include two inclined seams across the front flap dividing the printable area into three smaller portions.

It is also desirable therefore to produce a golf bag cover with a large printable area especially on the front portion of the cover that faces the user in accessing the golf clubs within the golf bag.

DISCLOSURE OF THE INVENTION

The invention provides a flexible golf bag cover of fabric for protecting the interior and contents of a golf bag from inclement weather, wherein the golf bag has an open top surrounded by a peripheral rim and having a carrying strap extending laterally from the rim, the golf bag cover comprising: a generally cylindrical base having an open bottom, rear and front base wall means for overlapping and holding the cover on the golf bag rim, the rear base wall means having openable slit means, with overlapping slit side edges each with continuous closure means, for closing the slit means about the carrying strap protruding through the slit means; a back wall extending upwardly from the rear wall means of the base to an apex, and having back lateral side edges; a front flap with front lateral side edges merging with the back lateral side edges, the front flap extending downwardly from the apex to a lower front edge, wherein the lower front edge of the front flap and a top edge of the front base wall define a flexible forwardly open mouth in an open configuration, and wherein the lower front edge of the front flap overlaps the top edge of the front base wall covering said mouth in a closed configuration.

Advantageously, the front flap between front lateral side edges is seamless enabling printing of logos and graphics. The ability to print large size graphics on the front flap which is always visible, is a significant distinction over prior art covers which often prevent printing by the location of seams, card holders, transparent panels and other features. The elimination of seams on the flap also reduces manufacturing costs by improving the nesting of blank cutouts and reducing labour involved in sewing the seams.

The use of a continuous closure enables the slit to surround the carrying strap improving waterproofing, and securing of the cover on the golf bag. Prior art covers utilize a slit with one or two spaced apart snap fasteners, which do not seal the slit as effectively as a continuous hook and loop strip fastener.

Various configurations of strap handles and their locations on the rim can be easily accommodated with a continuous strip fastener. The continuous fastener can close the slit above and below the strap extending through the slit at any point on its length to equal advantage. The continuous fastener can be wrapped tightly around the contours of the strap regardless of its location. This feature greatly improves the sealing and waterproofing capability of the cover. A conventional cover that uses one or two discreet fasteners often cannot properly close due to interference with the strap. As well, use of discreet fasteners leaves the slit substantially open in the area adjacent the strap, thereby permitting undesirable penetration by water into the golf bag.

Preferably, the front flap has a curved convex lower edge. This simple feature has numerous unobvious benefits. The convex shape allows the flap to better cover the open mouth of the cover when closed, and provides a larger overhanging hood when open to better prevent rain from entering the bag interior. The convex shape also facilitates shedding of rainwater which falls on the cover, runs down the front flap to the front edge, wherein the convex front edge channels droplets toward the center front to form water droplets which are quickly shed. The reinforcing seam edge binding around the mouth also serves to channel droplets toward the center of the flap lower edge.

Further details of the invention and its advantages will be apparent from the detailed description and drawings included below.

BRIEF DESCRIPTION OF THE DRAWINGS

In order that the invention may be readily understood a preferred embodiment of the invention will be described by way of example, with reference to the accompanying drawings wherein.

DETAILED DESCRIPTION OF PREFERRED EMBODIMENTS

Figure 1:
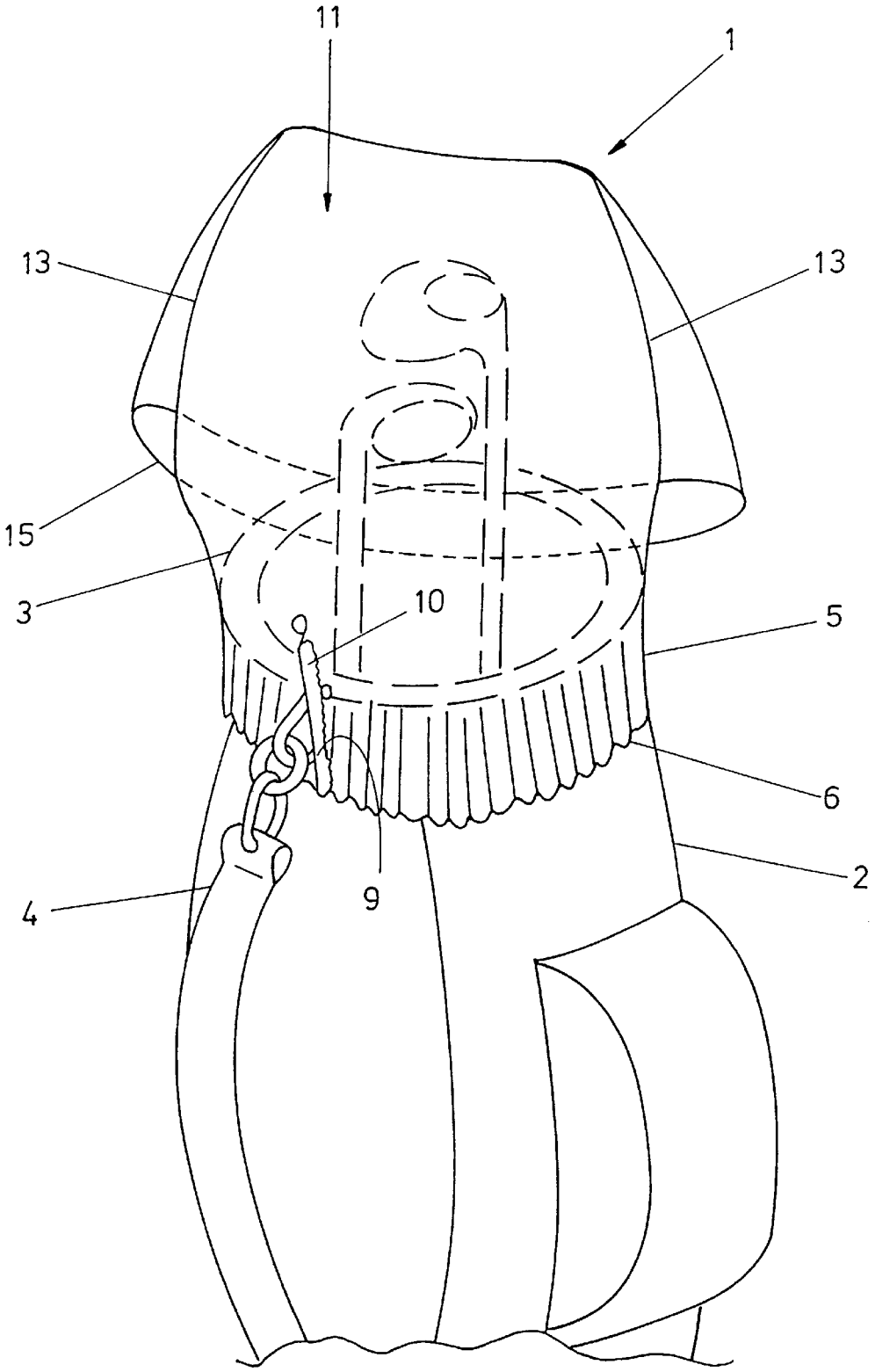
FIG. 1 is a rear perspective view of the golf bag cover installed in the upper rim of a golf bag, in particular showing the rear slit closed around the upper end of the carrying strap.

With reference to FIG. 1, the invention provides a flexible golf bag cover 1 of fabric for protecting the interior and contents of a golf bag 2 from inclement weather. The golf bag 2 is shown as a common type with an open top surrounded by a peripheral rim 3 and a carrying strap 4 extending laterally from the rim 3.

The golf bag cover 1 as seen in FIGS. 2–5 includes a generally cylindrical base 5 having an open bottom 6, with rear base wall portion 7 and front base wall portion 8 for overlapping and holding the cover 1 on the golf bag rim 3. The illustrated base 5 includes a bottom sleeve into which is inserted an elastic fabric band to produce pleats and enable the base 5 to be fitted over various types and sizes of rims 3. Other common means such as a draw string or multiple snap fasteners 23 may also be used, but to lesser advantage in adapting to different bag configurations.

The rear base wall portion 7 has openable slit 9, with overlapping slit side edges each with continuous closure means 10, for closing the slit 9 about the carrying strap 4 that protrudes through the slit 9. The continuous closures 10 are preferably fabric hook and loop strip fasteners such as those sold under the trademark Velcro or equivalent. These strip fasteners can be joined at any point or multiple points along their length and produces a substantially closed joint. This type of fastener represents a substantial improvement over conventional snap fasteners that merely join at discreet points leaving openings between fasteners and gaps between the strap 4 and slit 9.

The back wall 11 of the cover 1 extends upwardly from the rear wall 7 of the base 5 to an apex 12. The back wall 11 has back lateral side edges 13 that define inclined seams with the front flap 14.

The front flap 14 also front lateral side edges 13 merging with the back lateral side edges 13 joined at the seams. The front flap 14 extends downwardly from the apex 12 to a lower front edge 15. As a result, the front flap 14 presents a large printable surface free of seams or other discontinuities, best seen in FIG. 4. As explained above, failure to provide a large clear printable area prevents full marketing use of prior art cover designs. The front flap 14 between front lateral side edges 13 is seamless and completely available for optimal printing or application of graphics.

Figure 3:
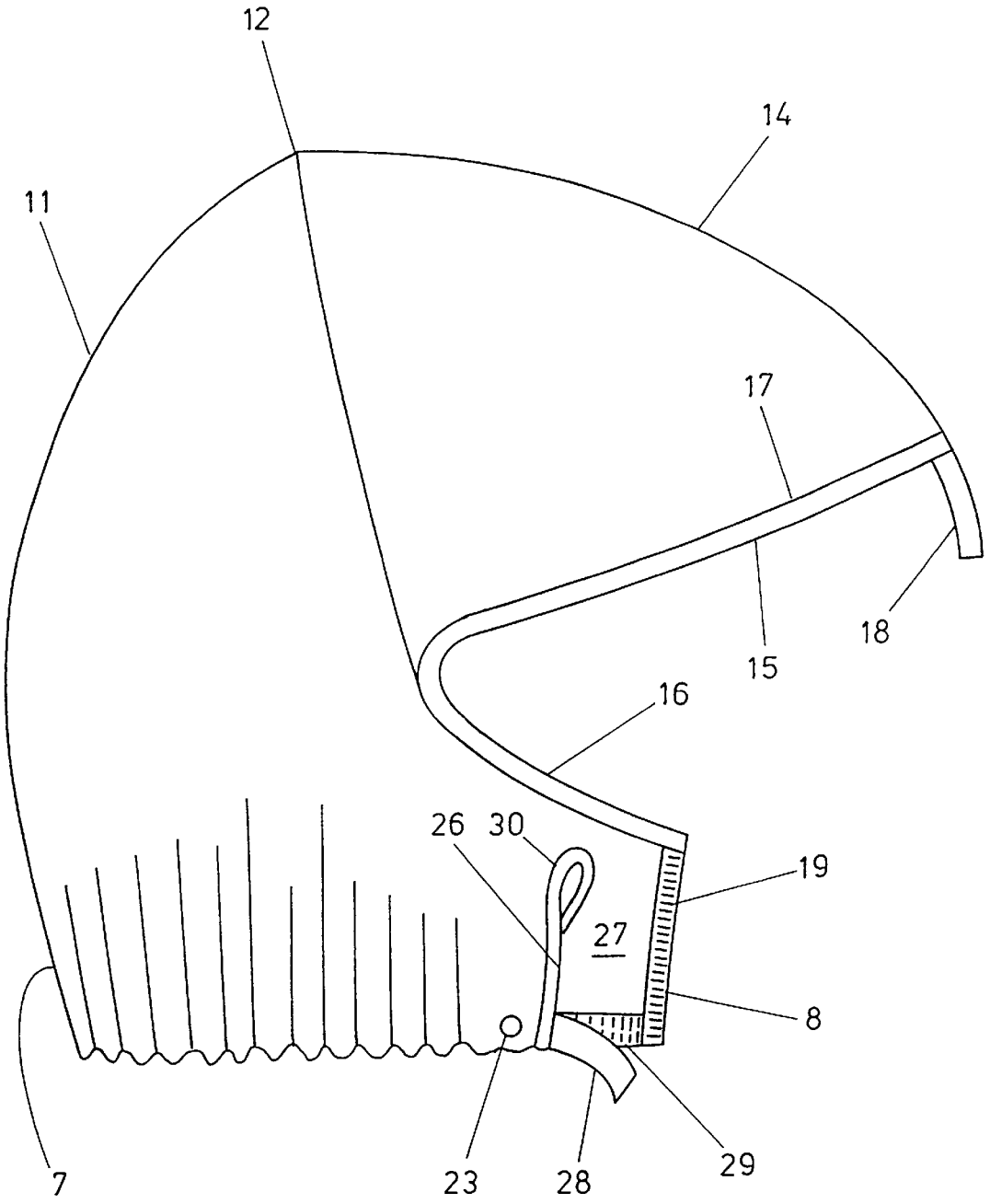
FIG. 3 is a left side elevation view of the open cover of FIG. 2.
Figure 4:
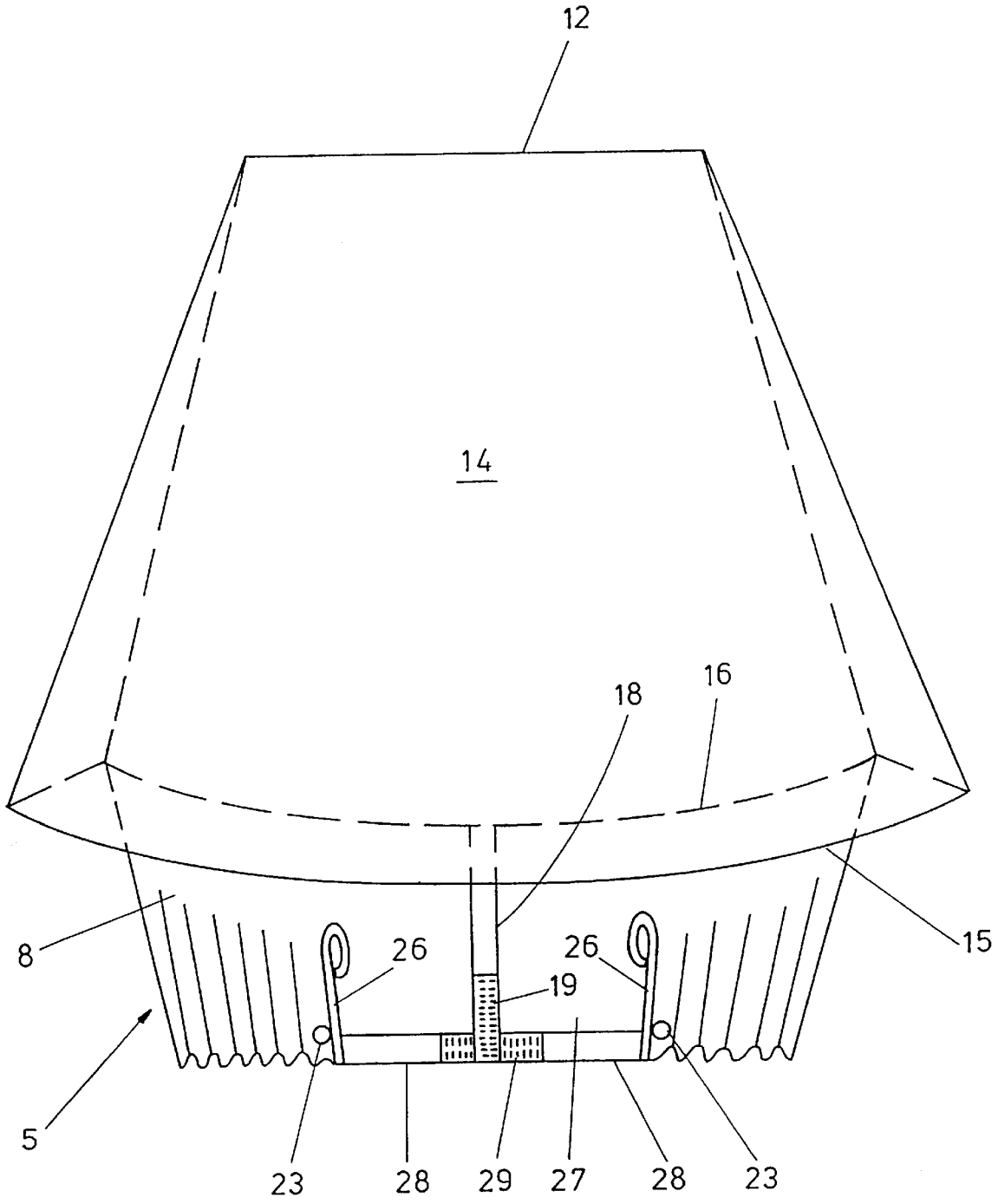
FIG. 4 is a front elevation view of the cover with front flap lowered to show the mouth in a closed position.
Figure 5:
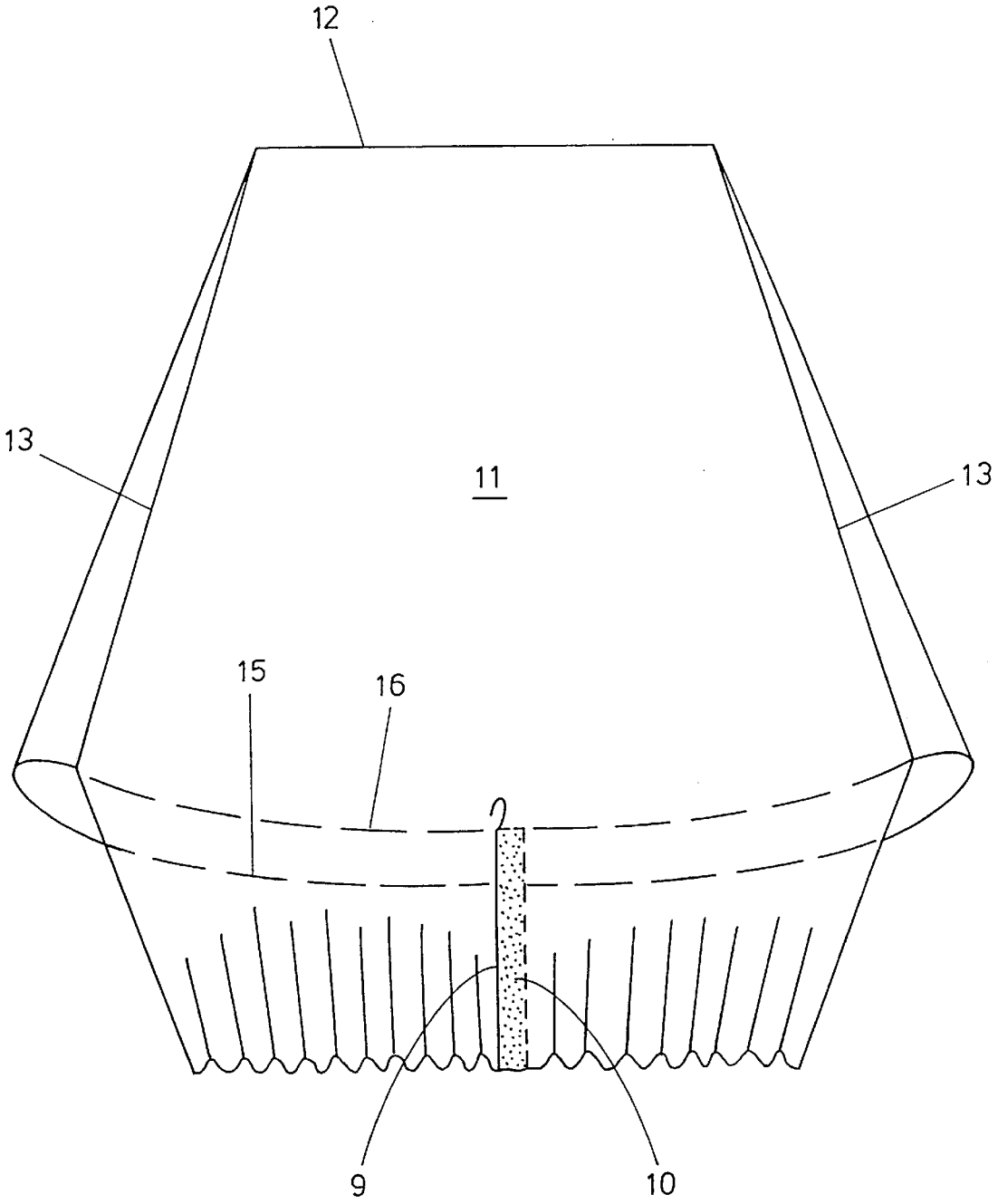
FIG. 5 is a rear elevation view of the closed cover of FIG. 4.

The lower front edge 15 of the front flap 14 and a top edge 16 of the front base wall 8 define a flexible forwardly open mouth in the open configuration, (shown in FIGS. 2–3) and the lower front edge 15 of the front flap 14 overlaps the top edge 16 of the front base wall 8 covering the mouth of the cover 1 in the closed configuration (shown in FIGS. 4–5 and 1).

Preferably the lower front edge 15 of the front flap 14 is convex downwardly. As mentioned above the convex shape allows the flap 14 to better cover the open mouth of the cover 1 when closed, provides a larger overhanging hood (as shown in FIG. 3) when open to better prevent rain from entering the bag interior, and facilitates shedding of rainwater which falls on the cover 1 by channeling droplets toward the center front to form water droplets which are quickly shed.

The mouth is reinforced with an encircling seam edge binding 17 to finish and strengthen the mouth area. The reinforcing seam edge binding 17 around the mouth also serves to channel droplets toward the center of the flap lower edge 15 as evident in FIG. 4.

The golf bag cover 1 also includes on the front flap 14 fastening means 18 for securing the front flap 14 to the front base wall 8. In the embodiment illustrated, a fabric tab 18 is sewn with Velcro type fabric hook and loop strip fastener means, with a mating strip 19 sewn on the adjacent front base wall 8.

Figure 2:
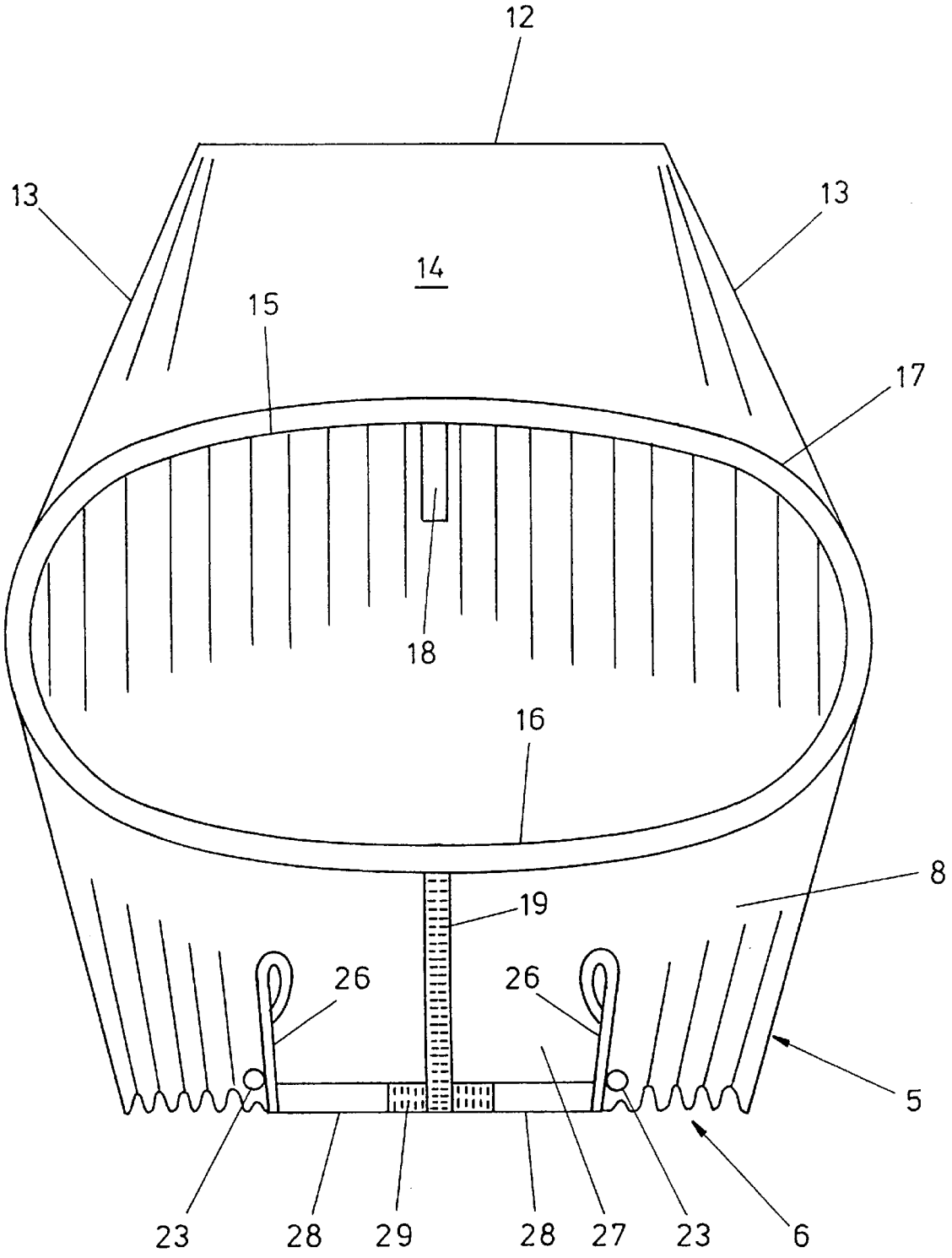
FIG. 2 is a front elevation view of the cover with front flap raised to show the open mouth through which golf clubs are accessed.

Preferably as shown in FIGS. 2–4, the front base wall 8 includes two vertical slits 26 extending upwardly from the base lower edge. The vertical slits 26 define a central front base flap 27, which is opened to fit the cover 1 on particular configurations of golf bags. In order to releasably fasten the base flap 27 to the adjacent front base wall 8, two base tabs 28 are sewn on the sides of the front base wall 8 and attach with hook and loop fastener strips 29 on the base flap 27.

For clarity, FIG. 3 shows the base flap 28 partially stripped away from the fastener strip 29. The cut edges of the base slits 26 are also reinforced with seam edge binding 30. The use of base tabs 28 and fastener strips 29 allows far greater adjustment in the fitting of the cover 1 on a variety of configurations or sizes of golf bags.

Figure 6:
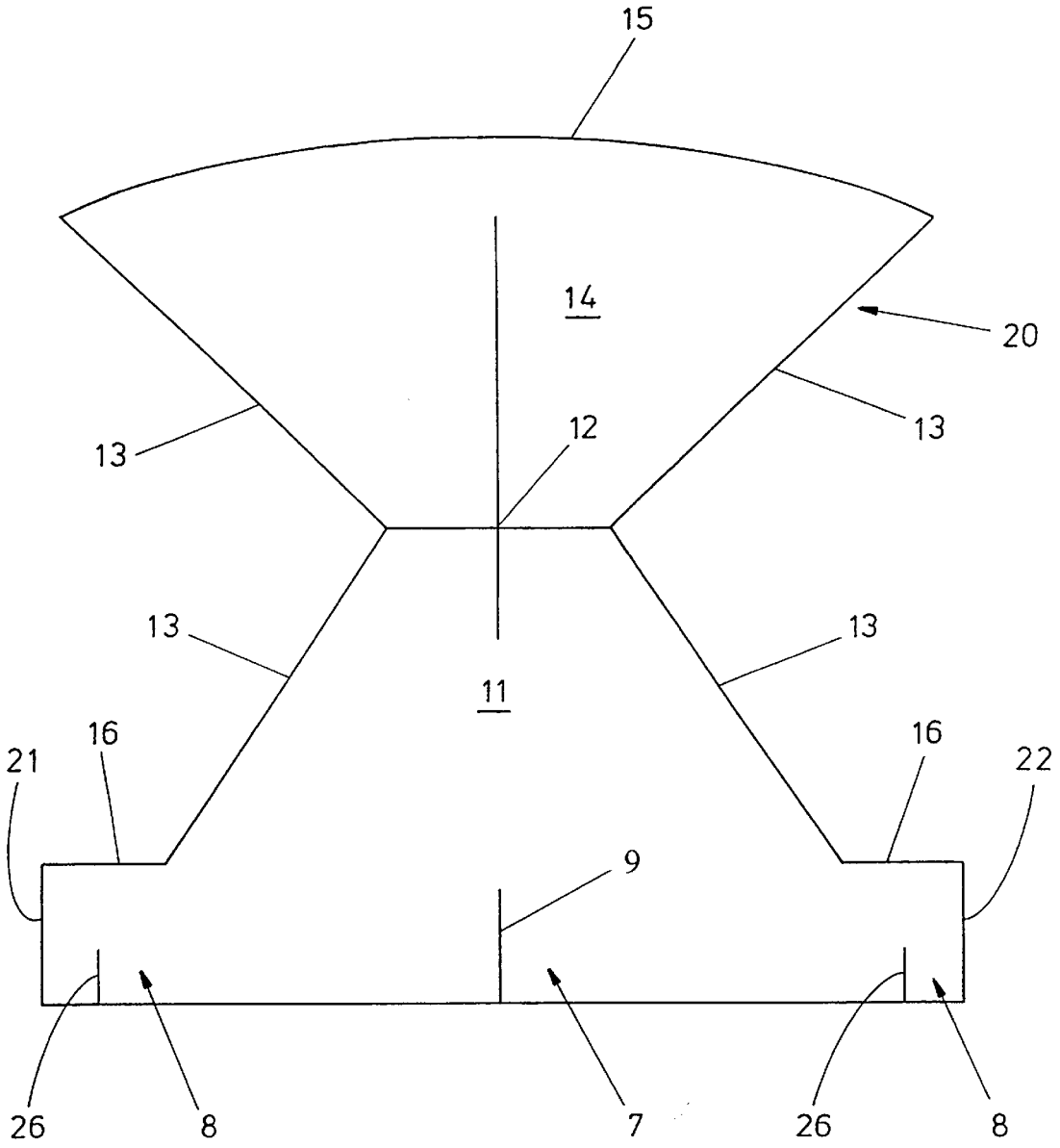
FIG. 6 is a plan view of the sheet fabric blank from which the invention is sewn together by sewing the inclined lateral side edges in two inclined seams to form the back wall and front flap, and is sewn together at the lower base portions in a vertical seam to form the base portion.

FIG. 6 shows a flat sheet blank of fabric 20 from which the cover is sewn. Preferably the fabric is inwardly lined with waterproof material. Like numerals on the blank 20 refer to the elements described above in respect of the finished sewn cover 1. Sewn seams join the front lateral side edges 13 with the back lateral side edges 13, and join a first lower base portion 21 and second lower base portion 22 of the blank 20.

Figure 7:
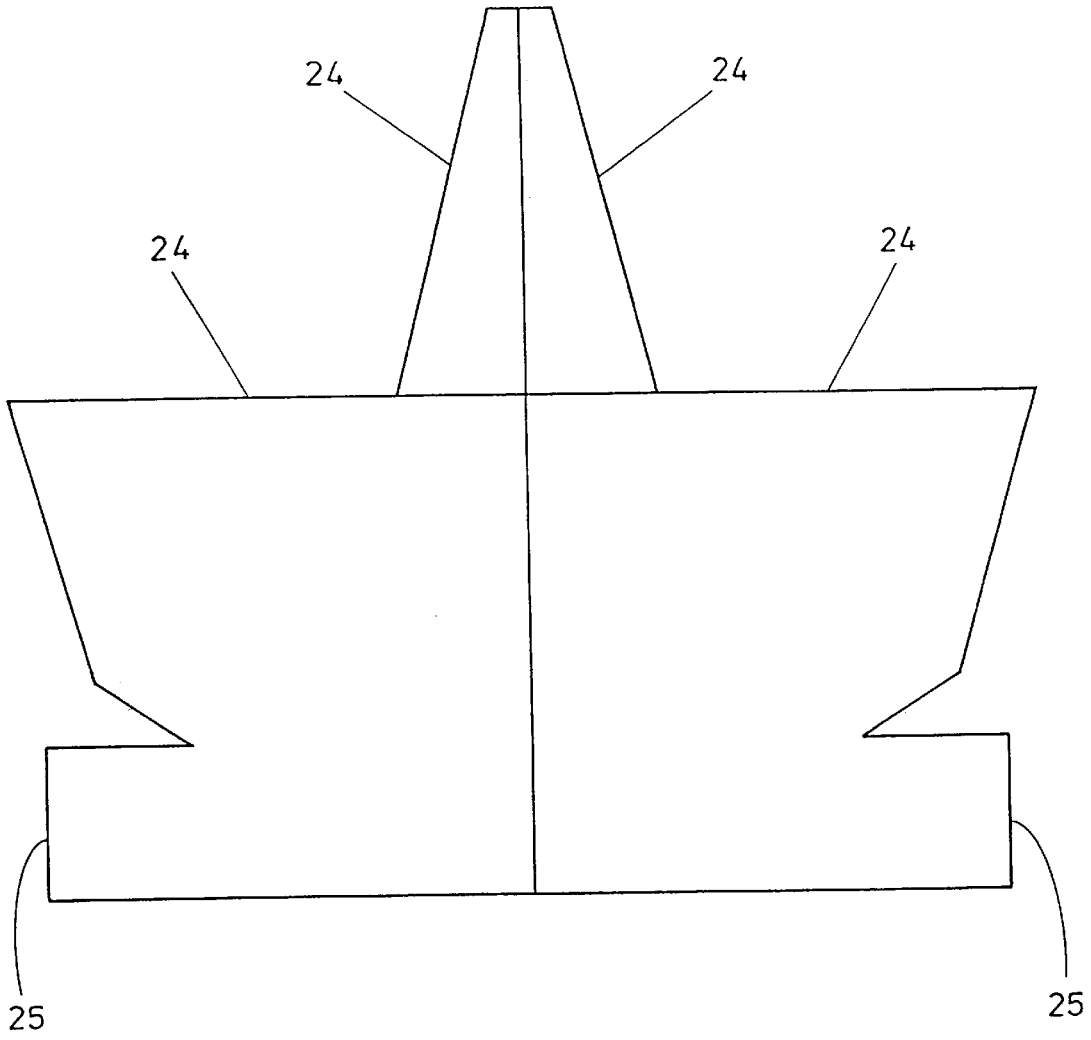
FIG. 7 PRIOR ART
FIG. 7 is a like plan view of a prior art cover which produces inclined seams across the front flap, preventing large size application of graphics to the front flap.

FIG. 7 shows a like blank prior art cutout which can be used to produce a prior art cover with seams extending across the front flap as in U.S. Pat. Des. No. 354,852 to Goddard et al, for example. Use of such a pattern requires base edges 25 to be sewn together to form a cylindrical base. Flap edges 24 are sewn together to produce two inclined seams across the front flap dividing the printable area into three smaller portions.

It will also be apparent, from a comparison of blanks in FIGS. 6 and 7, that the blank 20 of the invention not only produces a flap 14 with a large printable area, but that the improved nesting of blanks during the cutting operation reduces waste fabric in comparison to the prior art blank.

It is anticipated that a commercial embodiment of the invention will include various sizes for amateur golf bags, and professional touring models, however within such broad categories a single universal cover will be produced to accommodate most golf bags.

Although the above description and accompanying drawings relate to specific preferred embodiments as presently contemplated by the inventor, it will be understood that the invention in its broad aspect includes mechanical and functional equivalents of the elements described and illustrated.

I claim:

1. A flexible golf bag cover of fabric for protecting the interior and contents of a golf bag from inclement weather, wherein the golf bag has an open top surrounded by a peripheral rim and having a carrying strap extending laterally from the rim, the golf bag cover comprising:

a generally cylindrical base having a lower edge defining an open bottom, rear and front base walls for overlapping and holding the cover on the golf bag rim, the rear base wall having an openable slit, with overlapping slit side edges each with a continuous closure, for closing the slit about the carrying strap protruding through the slit;

a back wall extending upwardly from the rear base wall of the base to an apex, and having back lateral side edges;

a front flap with front lateral side edges merging with the back lateral side edges, the front flap being seamless between said front lateral side edges and extending downwardly from the apex to a lower front edge, wherein the lower front edge of the front flap and a top edge of the front base wall define a flexible forwardly open mouth in an open configuration, and wherein the lower front edge of the front flap overlaps the top edge of the front base wall covering said mouth in a closed configuration, said merging front and back lateral side edges forming seams which extend along the respective lateral side edges of the back wall and the front flap to the apex, to thereby define a self-supporting domed enclosure over the top of the golf bag.

2. A golf bag cover according to claim 1 wherein the continuous closure of the slit comprise fabric hook and loop strip fastener means.

3. A golf bag cover according to claim 1 wherein the lower front edge of the front flap is convex.

4. A golf bag cover according to claim 1 wherein the mouth is reinforced with an encircling seam edge binding.

5. A golf bag cover according to claim 1 wherein the front flap includes fastening means for securing the front flap to the front base wall.

6. A golf bag cover according to claim 5 wherein the fastening means comprise fabric hook and loop strip fastener means.

7. A golf bag cover according to claim 1 comprising a flat sheet blank of fabric, wherein said seams comprise sewn seams joining the front lateral side edges with the back lateral side edges, and joining a first and second lower base portion of the blank.

8. A golf bag cover according to claim 1 wherein the front base wall includes two vertical slits extending upwardly from the base lower edge, the vertical slits defining a central front base flap, and including means for releasably fastening the base flap to the adjacent front base wall.

* * * * *